US005661255A

United States Patent [19]

Webb, III

[11] Patent Number: 5,661,255

[45] Date of Patent: Aug. 26, 1997

[54] WEAPONS BARREL STABILIZER

[75] Inventor: Harry C. Webb, III, Houston, Tex.

[73] Assignee: Briley Manufacturing Co., Houston, Tex.

[21] Appl. No.: 551,757

[22] Filed: Nov. 7, 1995

[51] Int. Cl.[6] ..... F41A 31/32

[52] U.S. Cl. ..... 89/14.05; 42/76.01; 42/1.06

[58] Field of Search ..... 89/14.4, 14.05, 89/14.2; 42/76.01, 97, 1.06

[56] References Cited

U.S. PATENT DOCUMENTS

| | | | |
|---|---|---|---|
| H342 | 10/1987 | Geeter | 89/14.05 |
| 2,249,899 | 7/1941 | Hogg | 42/76 |
| 2,312,150 | 2/1943 | Conner | 42/75 |
| 2,752,714 | 7/1956 | Landwehr | 42/75 |
| 2,845,741 | 8/1958 | Day | 42/76 |
| 2,941,326 | 6/1960 | Hamil et al. | 42/75 |
| 2,952,089 | 9/1960 | Maier et al. | 42/76.01 |
| 2,967,368 | 1/1961 | Williams | 42/75 |
| 3,228,298 | 1/1966 | Grandy et al. | 89/16 |
| 3,299,558 | 1/1967 | Karl | 42/76 |
| 3,340,641 | 9/1967 | Recker | 42/97 |
| 3,399,597 | 9/1968 | Perrine | 89/14.4 |
| 3,439,441 | 4/1969 | Lawley | 42/75 |
| 3,732,778 | 5/1973 | Bettermann et al. | 89/14.05 |
| 3,742,640 | 7/1973 | Thomsen | 89/16 |
| 3,751,954 | 8/1973 | Ezra et al. | 72/56 |
| 4,057,924 | 11/1977 | Joseph | 42/75.01 |
| 4,130,959 | 12/1978 | Pedgonay | 42/78 |
| 4,296,669 | 10/1981 | Debona et al. | 89/1.816 |
| 4,406,080 | 9/1983 | Badali | 42/75 |
| 4,469,537 | 9/1984 | Ashton et al. | 148/440 |
| 4,537,742 | 8/1985 | Siemers et al. | 419/8 |
| 4,649,797 | 3/1987 | Elspass | 89/14.05 |
| 4,667,566 | 5/1987 | Bosshard et al. | 89/44.01 |
| 4,669,212 | 6/1987 | Jackson et al. | 42/76.02 |
| 4,864,761 | 9/1989 | Gregory | 42/75.01 |
| 4,913,031 | 4/1990 | Bossard et al. | 89/14.3 |
| 4,920,854 | 5/1990 | Scanlon | 89/14.4 |
| 5,077,926 | 1/1992 | Krumm | 42/78 |
| 5,183,958 | 2/1993 | Petrovich | 89/16 |
| 5,191,165 | 3/1993 | Oskarsson et al. | 89/15 |
| 5,196,637 | 3/1993 | Petrovich | 89/16 |
| 5,212,328 | 5/1993 | Petrovich | 42/76.02 |
| 5,279,220 | 1/1994 | Rose | 42/97 |
| 5,337,504 | 8/1994 | Krumm | 42/78 |
| 5,351,598 | 10/1994 | Schuetz | 42/71.01 |

*Primary Examiner*—Stephen M. Johnson

*Attorney, Agent, or Firm*—Pravel, Hewitt, Kimball & Krieger

[57] ABSTRACT

A weapons barrel oscillation reduction apparatus includes a plurality of donut shaped rings or washers mounted on the muzzle end portion of a weapons barrel. The weapons barrel has breech and muzzles end portions and provides a machined ring carrying outer surface at the muzzle end portion. An annular shoulder at one end portion of the ring carrying portions acts as a stop for the plurality of rings mounted thereon. A retainer can be removably attached to the opposite end of the ring carrying surface. Upon assembly, the rings can move slightly in a longitudinal direction with respect to each other during a firing of a projectile from the weapons barrel, the weight of the rings and the slight movement of the rings function to reduce barrel oscillation.

20 Claims, 2 Drawing Sheets

WEAPONS BARREL STABILIZER

BACKGROUND OF THE INVENTION

1. Field of the Invention

The present invention relates to weapons that include an elongated barrel having a rifled bore. More particularly, the present invention relates to an improved apparatus for removing oscillation in weapons barrels during the firing of a projectile by placement of a plurality of loosely spaced rings at the muzzles end of the barrel on a ring carrier wherein a retainer that holds the rings in position on the external surface of the muzzle end of the barrel, the ring holder defining a reduced diameter portion of the barrel at the muzzle end.

2. General Background

Rifled barrels oscillate when fired at a rate determined by the rigidity of the barrel. This movement resembles a coil spring in its motion, increasing in pitch as the bullet or projectile moves down the barrel. The pitch of the oscillation is at its greatest at the breech end because the barrel is most rigid at that point of the barrel/action joint.

Most barrels are made with a taper from the breech end to the muzzle end. The smallest diameter is provided at the muzzle end on most weapons. This variation in diameter creates a faster pitch in the oscillation at the muzzle and makes for a variable in bullet placement upon the exit of the barrel.

Several patents have issued that relate generally to the problem of stabilizing a rifle barrel. An example of an early stabilizer for a firearm can be seen in U.S. Pat. No. 2,752,714 issued to L. F. Landwehr. The Landwehr patent disclosed an invention that pertains to stabilizers such as are used on rifles in the practice known as bench shooting in which the rifle is supported on fixed support and fires repeatedly from such fixed position. The Landwehr '714 patent discloses a base having plurality of hydraulic cylinders as part of the system for stabilizing the firearm barrel.

Some gun barrels use a composite construction that includes circumferentially layered portions at the muzzle end of the barrel. For example, the Hogg U.S. Pat. No. 2,249,899 discloses a gun barrel construction that the inventor alleges is adapted to minimize barrel whip. The gun barrel construction of the '899 patent includes an outer sleeve of any elastic plastic material of high vibration damping properties co-adhesively bonded to the barrel, the inner elastic sleeve being covered with a protective sleeve co-adhesiably bonded thereto. Other early patents that include composite firearm barrels and/or the layering of materials on a steel or metal barrel include the U.S. Pat. Nos. 2,845,741 to Day; 2,941,326 to Hamil; 3,299,558 to Karl; 3,439,441 to Lawley; and 3,742,640 to Thomsen.

The Robert Joseph U.S. Pat. No. 4,057,924 provides a device for adjusting the force between the rifle barrel and the forearm of the stock comprising a stabilizing block having a concave groove formed on the upper surface thereof to engage the rifle barrel. An adjuster screw having an enlarged head is rotatably positioned in a socket formed in the lower side of the stabilizing block. Retaining pins retain the head of the screw within the socket. A screw housing is rigidly secured within the stock close to the end of the forearm. The adjuster screw is threadedly secured to the screw housing such that the stabilizing block may be moved relative to the screw housing and forearm to adjust the force on the rifle barrel.

The Debona et al. U.S. Pat. No. 4,296,669 discloses a rocket tube launcher with a cast-in place tube support bulkhead. The Ashton et al. U.S. Pat. No. 4,469,537 discloses an aluminum-magnesium-manganese alloy cold rolled to produce armor plate with allegedly improved ballistic properties.

A forearm for firearms is disclosed in U.S. Pat. No. 2,312,150. A chamber structure for guns is disclosed in U.S. Pat. No. 2,952,089. The mounting of a gun barrel in its stock is disclosed in U.S. Pat. No. 2,967,368. A rifle barrel that includes layers is disclosed in the Grandy et al. U.S. Pat. No. 3,228,298. The Recker U.S. Pat. No. 3,340,641 provides a method for improving the accuracy of firearms by reducing barrel vibration.

The Bettermann et al. U.S. Pat. No. 3,732,778 discloses a device on gun barrels for the reduction of the angle jump of a projectile, which comprises at least one reinforcement member fitted to the forward range of a gun barrel and is adapted to dampen bending oscillations occurring upon firing of the gun barrel. The Bettermann et al. patent '778 patent discloses a plurality of reinforcement members fitted to the forward range of a gun barrel and adapted to dampen bending oscillations upon firing of the gun barrel, the reinforcement members being disposed in the vicinity of muzzle of the gun barrel and comprising bodies enlarging in the range of plane-moment of an archer of the gun barrel. The reinforcement members are disposed in spaced apart locations at predetermined distances within the range of adjacent occurring loading peaks in the vicinity of the muzzle of the gun barrel.

A method and apparatus for explosive autofrettage is disclosed is U.S. Pat. No. 3,751,954. The '954 patent discloses an apparatus for producing residual compressive hoop stress at the inner bore of thick-walled tubes by the use of explosive charges positioned along the axis of said tubes. The explosive charge may be placed by itself along the axis of the thick-walled tube or may be enclosed in a second inner tube placed inside the thick-walled tube with an energy transmitting medium filling the space between the two tubes. The explosive charge is detonated producing pressure which plastically expands the thick-walled tube and causes residual compressive hoop stress to be developed at the inner bore upon dissipation of the pressure and elastic contraction of the thick-walled tube.

More recent patents that discuss the problem of accuracy include the Elspass U.S. Pat. No. 4,649,797 providing a gun barrel with reduced repeative jump angle. The '797 patent discloses an improved gun barrel in a tank cannon assembly having a recoiling mass. This gun barrel has an alleged increased target impact precision by virtue of stabilizing the bending oscillations and/or vibrations during firing, thereby making the jump angle more uniform from one firing to the next one. The L/D ratio of the gun barrel is stated as larger than 52 (where L represents the length of the gun barrel and D represents the caliber diameter). The gun barrel jacket has a frustro-conically shaped portion extending from the muzzle towards the rear of the gun barrel which is adjoined by a cylindrically shaped portion. The gun barrel is supported on a cradle along the latter portion. The gun barrel exhibits a continuous unbuckled bending line in its static and dynamic conditions between its muzzle and the cylindrical jacket portion. The frustro-conically shaped and cylindrically shaped portions merge into each other and have identical diameters along their merging line. The cylindrically shaped jacket portion is supported with respect to the firing direction along a distance a which is <7 D. The center of gravity of the recoiling mass is disposed within the frustro-conically shaped jacket portion of the gun barrel.

The Krumm U.S. Pat. No. 5,077,926 patent discloses a gun barrel said to be equipped with optimizing rifling. In order to improve the service life of prior art gun tubes and to improve the ballistics of a projectile fired through them, the '926 patent provides a gun tube with an "optimized" variable rifling which products a rifling force curve (R(x)) along the gun tube (x) which has an essentially trapezoidal shape with alleged reduced rifling force maximum compared to the rifling force curves of conventional constant rifling.

The Oskarsson et al. U.S. Pat. No. 5,191,165 relates to a method of producing rifled, non-metallic barrels of composite material in the form of a fiber-reinforced thermosetting matrix for rocket and grenade launcher ordnance, and barrels produced in accordance therewith.

The Jackson et al. U.S. Pat. No. 4,669,212 provides a gun capable of operating at relatively higher temperatures. The barrel of the gun is made up of at least two layers. The inner layer is of a refractory material which may be a metal refractory or a non-metal refractory. The liner is bonded to an outer jacket material formed of an alloy of nickel, aluminum and molybdenum. The coefficient of expansion of the liner and of the jacket are relatively low so that the gun does not expand extensively when heated by intensive use. The jacket metal is of higher strength at elevated temperature than is the conventional gun barrel steel.

The Petrovich U.S. Pat. No. 5,212,328 discloses a non-metallic gun barrel having a longitudinally rigid tube exterior capable of radial elastic deformation upon passage of a projectile therethrough. Liner segments fixed at the inner diameter of the barrel exterior are abutted end to end and form spiraled rifling structures comprised of shallow channels and ridges between the channels. Radial gaps between sides of the liners can be partly filled by radial projections of elastomeric material of the barrel exterior. The radial projections expand inwardly to seal against a projectile bearing against the inner periphery of the barrel as the projectile is fired from the barrel.

A United States Statutory Invention Registration H342 discloses an, apparatus to improve the accuracy of weapons through barrel flexure.

The Pedgonay U.S. Pat. No. 4,130,959 provides a rifled ordinance mounting system for controlling trajectory errors normally imparted on projectile emergence as result of barrel torsional windup and spring back includes a mounting which holds the barrel at the muzzle, the holding being with a torsional rigidity exceeding the torsional rigidity of the barrel.

An anti-twist forearm mounting system is disclosed in U.S. Pat. No. 4,406,080. The forearm of a pump shotgun is mounted for a reciprocal movement with respect to the magazine tube through a coupling system which prevents twisting of the forearm. A coupling system includes grooves in the exterior sidewall of the magazine tube and detents on the exterior sidewall of the forearm mount tube in registration with the grooves.

U.S. Pat. No. 4,537,742 discloses a method for forming articles from difficult to fabricate materials with precise internal dimensions. The article is first formed to approximate dimensions as a body using the material in powdered form. Plasma spray forming is proposed. The powdered formed body is then brought to its final dimensions by consolidating and densifying the body about the densifying mandrel having a coefficient of expansion which is higher and outer dimensions which are slightly smaller than that of the body.

A countercoil and recoil damper for an automatic firearm which ensures floating support of the weapon during automatic bursts of fire is disclosed in U.S. Pat. No. 4,667,566.

A barrel vibration dampening device for rifles is disclosed in U.S. Pat. No. 4,864,761. The vibration dampening device disclosed in the '761 patent is provided in the forearm of a rifle for engaging a cantilevered barrel forward of the rifle action for dampening the vibration of the barrel as a bullet moves through the barrel to the muzzle. The vibration dampening device includes an insert that is mounted in a cavity formed in the forearm. The insert includes a threaded bore with a pressure screw threadably mounted in the bore in which the threaded screw has a pointed end engaging the barrel at a selected point. A tool access aperture extends through the forearm from the lower profile surface in alignment with the threaded bore for enabling a tool to be inserted through a tool access aperture to engage the pressure screw to rotate the pressure screw to the desired position. A locking means is provided for locking the pressure screw in place when the correct pressure is obtained.

The Petrovich U.S. Pat. No. 5,183,958 non-metallic gun barrel. Another non-metallic gun barrel is disclosed in the Petrovich U.S. Pat. No. 5,196,637. Another Krumm U.S. Pat. No. 5,337,504 relates to a gun tube having a spin curve with a variable spin angle. Some of these patents relate generally to the problem of barrel vibration during firing. However, none of this known prior art is believed a solution to the problem of inherent oscillation in rifle metal washers or rings placed in loose fit arrangement on the outside of the muzzle end of the barrel.

SUMMARY OF THE INVENTION

The present invention provides a weapons barrel oscillation reduction apparatus that in the preferred embodiment is a rifle. The apparatus includes an elongated weapons barrel having breach and muzzle end portions. The barrel has an outer surface and internally a rifled bore with a longitudinal axis that tracks the path of a projectile that is fired from the barrel.

The muzzle end portion of the barrel has a ring mount portion for holding a plurality of rings. In the preferred embodiment, these rings are positioned side-by-side but loosely arranged to provide some slippage between the rings. This allows the rings to move relative to one another when a projectile is fired.

The plurality of rings are mounted on the muzzle end portion of the barrel at the ring mount, wherein each of the rings occupies a reduced diameter portion of the barrel. Each of the rings is preferably a circular disk, having a central circular opening that receive the barrel. Each ring is positioned adjacent another ring on the barrel at the ring central openings.

A retainer nut prevents substantial longitudinal movement of the rings relative to the barrel and one another. The retainer keeps the rings at the barrel muzzle end. The retainer can be a threaded nut having a opening center that fits external threads on the barrel. The retainer can be cylindrically shaped, defining an annular shoulder that extends away from the barrel upon assembly for preventing removal of the rings from the barrel muzzle end.

In preferred embodiment, a number of rings (preferably six-eight) provide the necessary span of distance to cover the sign wave and reduce the oscillation. The additional benefit of the rings can be directly related to the use of a particular material, preferably Tungsten or Carbide. These material have properties that do not perpetuate harmonic vibrations, thus being ideally suited for oscillation reduction in weapons barrels.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
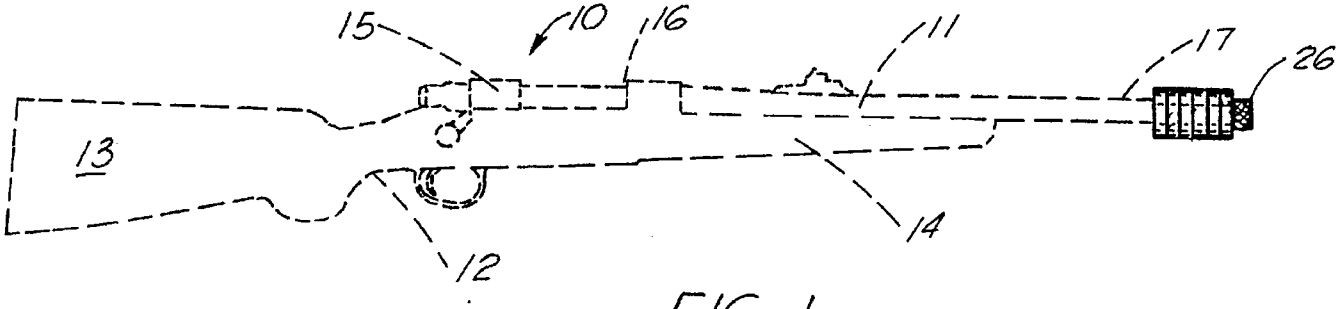
FIG. 1 is a side elevational view of the preferred embodiment of the apparatus of the present invention.

FIG. 1 show generally the preferred embodiment of the apparatus of the present invention designated generally by the numeral 10. Weapon 10 provides an elongated rifled barrel 11 having a rifled bore 19 for accepting a bullet. It should be understood that the rifled bore 19 extends longitudinally, the full length of the barrel between the breech end 16 and muzzle end 17. The weapon 10 includes a stock 12 that has a butt end 13 and a forearm 14 portion.

An action 15 (such as a commercially available bolt action as shown) is provided for receiving a bullet and for locking the bullet into a position at the breech end 16 of the barrel for firing. The barrel 11 breech end 16 is typically of a larger outer diameter. The barrel 11 gradually tapers toward the muzzle end 17, having a smaller outer diameter than breech end 16. A bullet placed in the breech end 16 portion is fired causing a projectile portion of the bullet to travel in rifled bore 19 from the breech 16 end portion to the muzzle 17 end portion exiting the barrel 11 at a high velocity.

Rifle barrels 11 oscillate when fired, at a rate determined by the rigidity of the barrel. This movement resembles a coil spring in its motion decreasing in pitch as the bullet moves down the barrel 11. The pitch of oscillation is at its slowest at the breech end 16 because the barrel 11 is most rigid at that point of the barrel/action joint. Most barrels 11 are made with a taper from the breech 16 to muzzle 17 end portion. This physical dimensioning creates a faster pitch in the oscillation and makes for a variable in bullet placement upon exit of the barrel 11 at the muzzle 17.

Figure 2:
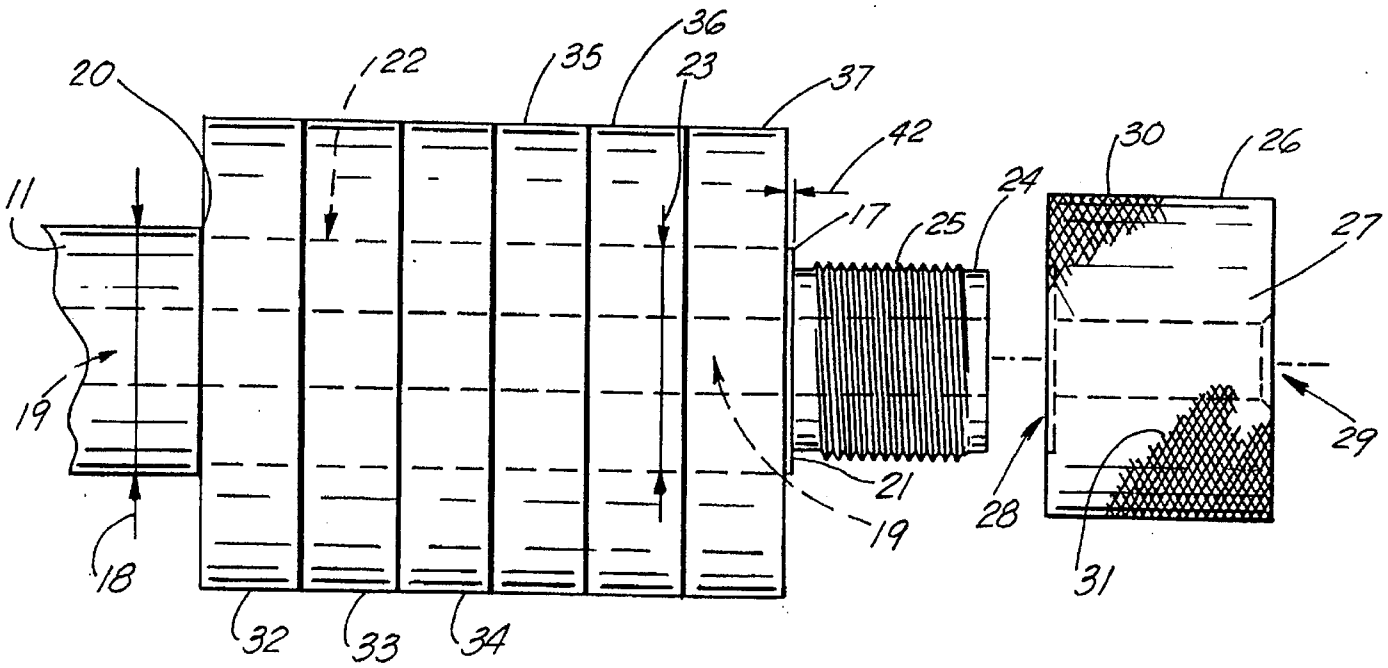
FIG. 2 is a fragmentary elevational view of the preferred embodiment of the apparatus of the present invention.
Figure 3:
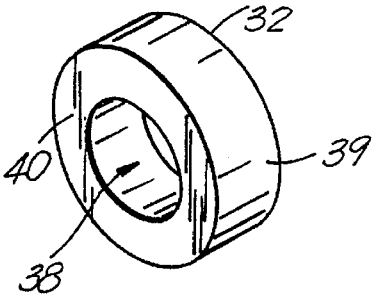
FIG. 3 is a fragmentary view of the preferred embodiment of the apparatus of the present invention illustrating a ring portion thereof.
Figure 4:
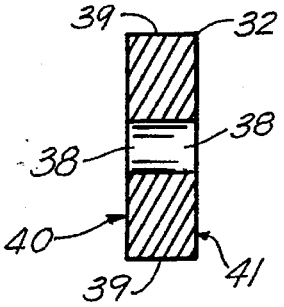
FIG. 4 is a fragmentary sectional view of the ring portion of FIG. 3.
Figure 5:
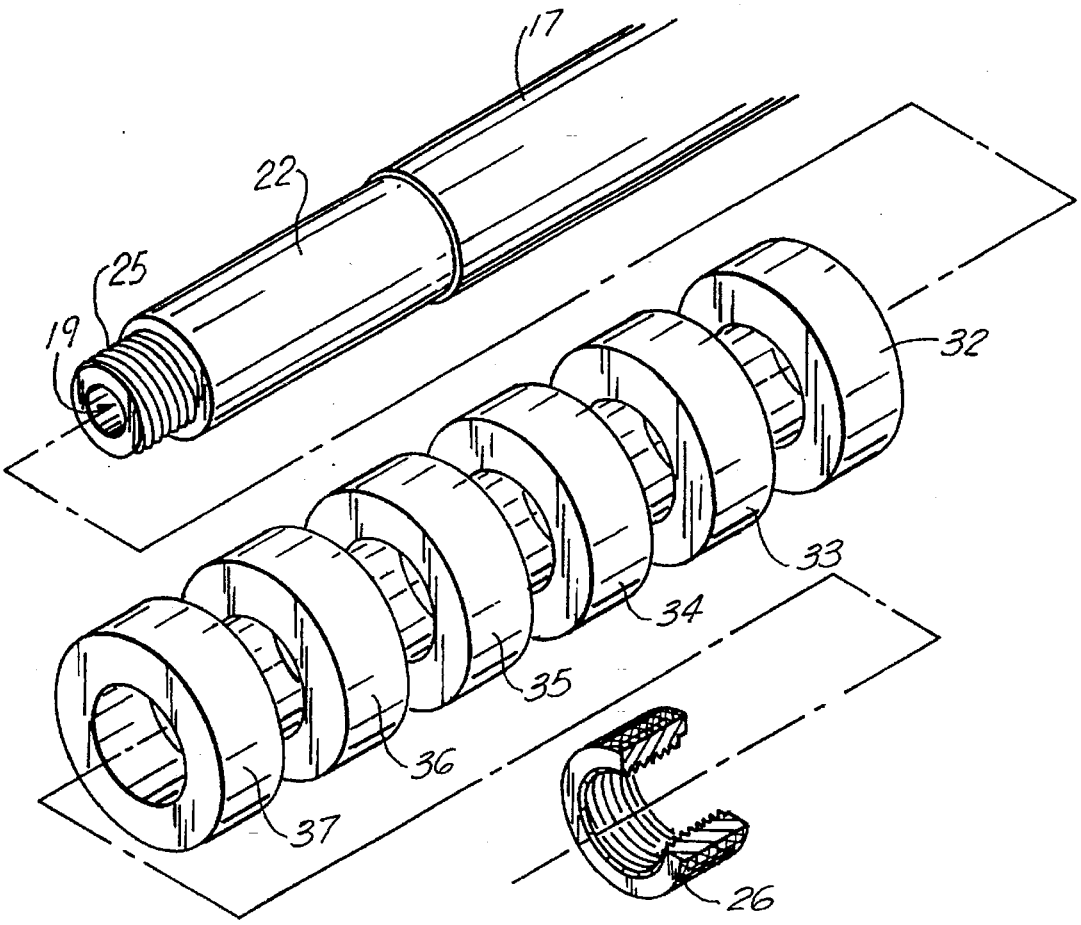
FIG. 5 is a partial, exploded perspective view of the preferred embodiment of the apparatus of the present invention.

The muzzle end 17 (see FIG. 2) of barrel 11 is generally of the smallest outer diameter when compared to the other portions of the barrel. The outer diameter of the barrel 11 gradually decreases in a smooth fashion as is known in the art from the breech end 16 to the muzzle end 17. The muzzle end 17 as shown in FIG. 2 provides an outer diameter 18. However, a number of sections of smaller diameter are provided at muzzle end 17 with the teaching of the present invention as shown in FIGS. 2 and 5.

In FIGS. 2–5, barrel 11 at muzzle end 17 can be seen to have a first outer diameter section indicated by outer diameter 18, a some what smaller diameter machined section 22 and a smallest diameter machined section 24. An annular shoulder 20 forms a transition between muzzle end 17 at the indicated diameter 18 and the first machined section 22 as shown in FIG. 2. Similarly, an annular shoulder 21 defines an interface between the first machined section 22 and smallest diameter machined section 24.

The section 22 presents a smooth cylindrically shaped outer surface that holds a plurality of washers or rings. The portion 22 defines a ring carrying portion having an outer diameter indicated as 23 in FIG. 2. The smallest diameter section 24 provides an externally threaded portion having external threads 25. The external threads 25 cap nut 26. Cap nut 26 has an internally threaded bore 27 that engages the threads 25 upon assembly as shown in FIGS. 1–2. The threaded bore 27 is open at end portions 28, 29. Outer surface 30 of nut 26 can provide a gripping surface so that the nut can be tightened manually. In the embodiment of FIG. 2, a knurled surface 31 is provided on the outer surface 30 of cap nut 26.

A plurality of rings 32–37 are contained and supported upon the ring carrying section 22 of barrel 11. The rings (see FIGS. 3–4) are each donut shaped, providing a cylindrically shaped opening 38 at the center of each ring 32, a cylindrically shaped peripheral edge 39, and a pair of parallel flat faces 40, 41. The cylindrically shaped central opening 38 is sized and shaped to conform to the ring carrying section 22, being slightly larger in diameter than the ring carrying section 22 so that the rings 32–37 are free to float for and aft on the barrel 11 during firings. However, the central opening 38 of each ring 32–37 is smaller than the measured outer diameter 18 of barrel 17. The annular shoulder 20 acts as a stop for the ring 32, holding it on the ring carrying section 22 during use by limiting its travel in a direction toward breech end 16. The cap nut 26 also defines a stop for the plurality of rings 32–37. The cap nut 26 provides an overall outer diameter that is greater than opening 38 internal diameter. In this fashion, the annular shoulder 20 and the cap nut 26 function to maintain the plurality of rings 32–37 therebetween and upon ring carrying section 22 of barrel 11.

Gap 42 is provided between the annular shoulder 21 and the last ring 37 upon assembly as shown in FIG. 2. Further, the cap nut 26 is prevented from moving beyond the annular shoulder 21 because the cap nut internal bore diameter 27 closely fits the smallest diameter section 24. This gap 42 allows the each of the rings 32–37 to move longitudinally when the gun is fired. Such slight movement of the rings 32–37 fore and aft during firing helps remove oscillation in the barrel 11, improving accuracy.

The following table lists the parts numbers and parts descriptions as used herein and in the drawings attached hereto.

PARTS LIST

| Part Number | Description |
|---|---|
| 10 | weapon |
| 11 | barrel |
| 12 | stock |
| 13 | butt |
| 14 | forearm |
| 15 | action |
| 16 | breech end |
| 17 | muzzle end |
| 18 | outer diameter |
| 19 | rifled bore |
| 20 | annular shoulder |
| 21 | annular shoulder |
| 22 | ring carrying portion |
| 23 | outer diameter |
| 24 | externally threaded portion |

-continued

PARTS LIST

| Part Number | Description |
|---|---|
| 25 | external threads |
| 26 | cap nut |
| 27 | internal bore |
| 28 | open end |
| 29 | open end |
| 30 | outer surface |
| 31 | knurled surface |
| 32 | ring |
| 33 | ring |
| 34 | ring |
| 35 | ring |
| 36 | ring |
| 37 | ring |
| 38 | opening |
| 39 | peripheral edge |
| 40 | flat face |
| 41 | flat face |
| 42 | gap |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A rifle comprising:

a) a rifle stock having gripping surfaces thereon for enabling a user to grip the stock;

b) an elongated rifle barrel having breech and muzzle end portions, a rifle barrel outer surface and a rifled bore;

c) the muzzle end portion of the barrel having a ring mount for holding a plurality of rings;

d) said plurality of rings mounted on the muzzle end portion of the barrel at the ring mount, each of said rings having opposed generally flat surface portions and a central opening that is slightly larger than the outer surface of the barrel at the muzzle end portion, said rings being positioned together during use, one adjacent another on the barrel at the ring central openings, and wherein the opposed generally flat surfaces of one ring are positioned to engage the corresponding surface of an adjacent ring;

e) a retainer that fits the muzzle end portion of the barrel, the retainer having an open center that fits the barrel, the retainer having a portion that extends away from the barrel for preventing removal of the rings from the barrel muzzle end portion; and f) wherein the rings are loosely spaced relative to one another, enabling each said ring to move longitudinally relative to the others during firing of a projectile from the barrel.

2. The rifle of claim 1 wherein the rings are metallic.

3. The rifle of claim 1 wherein each of the rings is generally cylindrically shaped.

4. The rifle of claim 1 wherein the rifle muzzle end portion comprises a plurality of sections of varying diameter including a larger diameter section and a smaller diameter section that holds the rings.

5. The rifle of claim 4 wherein the rifle muzzle end portion comprises a plurality of sections of varying diameter including a larger diameter section and a smaller diameter section of generally uniform diameter that holds the rings.

6. The rifle of claim 1 wherein the rings are positioned adjacent one another to define a cylindrically shaped group, the group being loosely spaced upon the muzzle end portion of the barrel, and the retainer comprises a nut that threadably fits the muzzle end portion of the barrel for retaining the rings upon the barrel, said nut being removable to allow rings to be added to or removed from the barrel.

7. A rifle comprising:

a) a rifle stock having gripping surfaces thereon for enabling a user to grip the stock;

b) an elongated rifle barrel having breech and muzzle end portions, a rifle barrel outer surface and a rifled bore;

c) the muzzle end portion of the barrel having a ring mount for holding a plurality of rings;

d) said plurality of rings mounted on the muzzle end portion of the barrel at the ring mount, each of said rings having opposed generally flat surface portions and a central opening that is slightly larger than the outer surface of the barrel at the muzzle end portion, said rings being positioned together during use, one adjacent another on the barrel at the ring central openings, and wherein the opposed generally flat surfaces of one ring are positioned to engage the corresponding surface of an adjacent ring;

e) a retainer that fits the muzzle end portion of the barrel, the retainer having an open center that fits the barrel, the retainer having a portion that extends away from the barrel for preventing removal of the rings from the barrel muzzle end portion;

f) wherein the rings are loosely spaced relative to one another, enabling each said ring to move longitudinally relative to the others during firing of a projectile from the barrel; and g) wherein the rings are tungsten.

8. A rifle comprising:

a) a rifle stock having gripping surfaces thereon for enabling a user to grip the stock;

b) an elongated rifle barrel having breech and muzzle end portions, a rifle barrel outer surface and a rifled bore;

c) the muzzle end portion of the barrel having a ring mount for holding a plurality of rings;

d) said plurality of rings mounted on the muzzle end portion of the barrel at the ring mount, each of said rings having opposed generally flat surface portions and a central opening that is slightly larger than the outer surface of the barrel at the muzzle end portion, said rings being positioned together during use, one adjacent another on the barrel at the ring central openings, and wherein the opposed generally flat surfaces of one ring are positioned to engage the corresponding surface of an adjacent ring;

e) a retainer that fits the muzzle end portion of the barrel, the retainer having an open center that fits the barrel, the retainer having a portion that extends away from the barrel for preventing removal of the rings from the barrel muzzle end portion; and f) wherein the rings are loosely spaced relative to one another, enabling each said ring to move longitudinally relative to the others during firing of a projectile from the barrel; and g) wherein the rings are carbide.

9. A weapons barrel oscillation reduction apparatus comprising:

a) an elongated weapons barrel having breech and muzzle end portions, a barrel outer surface and a rifled bore;

b) the muzzle end portion of the barrel having a ring mount for holding a plurality of at least three closely spaced rings;

c) said plurality of at least three rings mounted on the muzzle end portion of the barrel at the ring mount, each of said rings having opposed flat surface portions and a central opening that accommodates the barrel, said rings being closely spaced during use, positioned one adjacent the other on the barrel at the ring central openings;

d) a retainer that fits the muzzle end of the barrel, the retainer having an open center that fits the barrel, the retainer having a portion that extends away from the barrel for preventing removal of the rings from the barrel muzzle end portion; and e) wherein the rings are closely but loosely spaced enabling each ring to move longitudinally relative to the others during the firing of a projectile.

10. The oscillation reduction apparatus of claim 9 wherein the rings are metallic.

11. The oscillation reduction apparatus of claim 9 wherein each of the rings is generally cylindrically shaped.

12. The oscillation reduction apparatus of claim 9 wherein the muzzle end portion comprises a plurality of sections of varying diameter including a larger diameter section and a smaller diameter section that holds the rings.

13. The oscillation reduction apparatus of claim 12 wherein the muzzle end portion comprises a plurality of sections of varying diameter including a larger diameter section and a smaller diameter section of generally uniform diameter that holds the rings.

14. The oscillation reduction apparatus of claim 9 wherein the rings are positioned adjacent one another to define a cylindrically shaped group, the group being loosely spaced upon the muzzle end portion of the barrel, and the retainer comprises a nut that threadably fits the muzzle end portion of the barrel for retaining the rings upon the barrel, said nut being removable to allow rings to be added to or removed from the barrel.

15. The oscillation reduction apparatus of claim 9 further comprising a support for securing the barrel in fixed position during firing.

16. The oscillation reduction apparatus of claim 15 wherein the support is a rifle stock and forearm.

17. A weapons barrel oscillation reduction apparatus comprising:

a) an elongated weapons barrel having breech and muzzle end portions, a barrel outer surface and a rifled bore;

b) the muzzle end portion of the barrel having a ring mount for holding a plurality of at least three closely spaced rings;

c) said plurality of at least three rings mounted on the muzzle end portion of the barrel at the ring mount, each of said rings having opposed flat surface portions and a central opening that accommodates the barrel, said rings being closely spaced during use, positioned one adjacent the other on the barrel at the ring central openings; .

d) a retainer that fits the muzzle end of the barrel, the retainer having an open center that fits the barrel, the retainer having a portion that extends away from the barrel for preventing removal of the rings from the barrel muzzle end;

e) wherein the rings are closely but loosely spaced enabling each ring to move longitudinally relative to the others during the firing of a projectile; and f) wherein the rings are tungsten.

18. A weapons barrel oscillation reduction apparatus comprising:

a) an elongated weapons barrel having breech and muzzle end portions, a barrel outer surface and a rifled bore;

b) the muzzle end portion of the barrel having a ring mount for holding a plurality of at least three closely spaced rings;

c) said plurality of at least three rings mounted on the muzzle end portion of the barrel at the ring mount, each of said rings having opposed flat surface portions and a central opening that accommodates the barrel, said rings being closely spaced during use, positioned one adjacent the other on the barrel at the ring central openings;

d) a retainer that fits the muzzle end of the barrel, the retainer having an open center that fits the barrel, the retainer having a portion that extends away from the barrel for preventing removal of the rings from the barrel muzzle end;

e) wherein the rings are closely but loosely spaced enabling each ring to move longitudinally relative to the others during the firing of a projectile; and f) wherein the rings are carbide.

19. A weapons barrel oscillation reduction apparatus comprising:

a) an elongated weapons barrel having breech and muzzle end portions, a barrel outer surface and a rifled bore;

b) the muzzle end portion of the barrel having plurality of sections differing external diameter, one of said sections being of an external diameter that is smaller than the external diameter of a majority of said barrel, defining a ring mount for holding a plurality of rings;

c) a plurality of at least three rings mounted on the muzzle end portion of the barrel at the ring mount, each of said rings having a central opening that is sized and shaped to closely conform to the outer surface of the barrel, said rings being positioned one adjacent the other on the barrel at the ring central openings;

d) a retainer that fits the muzzle end portion of the barrel, the retainer having an open center that fits the barrel, the retainer having a portion that extends away from the barrel for preventing removal of the rings from the barrel muzzle end portion; and e) wherein the rings are closely but loosely spaced enabling each ring to move longitudinally relative to the others during the firing of a projectile.

20. A weapons barrel oscillation reduction apparatus comprising:

a) an elongated weapons barrel having breech and muzzle ends portions, a barrel outer surface and a rifled bore with a longitudinal axis that defines the path of a projectile that is fired from the barrel;

b) the muzzle end portion of the barrel having larger diameter section and an adjacent smaller diameter section defining a ring mount portion for holding a plurality of rings;

c) a plurality of at least three rings mounted on the muzzle end portion of the barrel at the ring mount portion, each of said rings having a central opening that receives the barrel;

d) a retainer for preventing substantial longitudinal movement of the rings relative to the barrel and one another, said retainer keeping the rings at the barrel muzzle end portion on the smaller diameter section and in between the larger diameter section and the retainer;

e) the rings and retainer being sized to allow some play between adjacent rings during firing of a projectile from the weapons barrel; and f) wherein the rings are closely but loosely spaced enabling each ring to move longitudinally relative to the others during the firing of a projectile.

* * * * *